US005809853A

United States Patent [19]

Hudson

[11] Patent Number: 5,809,853

[45] Date of Patent: Sep. 22, 1998

[54] PROTECTIVE GRIP FOR PLIERS-TYPE TOOL

[76] Inventor: Robert V. Hudson, 353 S. E. Creek Rd., Church Hill, Md. 21623

[21] Appl. No.: 731,971

[22] Filed: Oct. 23, 1996

[51] Int. Cl.[6] ..... B25B 7/00

[52] U.S. Cl. ..... 81/427.5; 81/489; 81/415; 30/233; 30/232

[58] Field of Search ..... 81/415, 427.5, 81/489, 177.1; 30/232, 233, 295, 298, 191, 193, 194, 211, 252; 72/409.01, 409.02; 29/221, 223, 242, 248, 268; 16/111 R, DIG. 12

[56] References Cited

U.S. PATENT DOCUMENTS

| | | | |
|---|---|---|---|
| D. 255,974 | 7/1980 | Jacoby | 30/295 X |
| 836,851 | 11/1906 | Alves | 16/DIG. 12 X |
| 859,804 | 7/1907 | Daniel | 16/DIG. 12 X |
| 1,453,854 | 5/1923 | Parker | 81/427.5 X |
| 2,798,491 | 7/1957 | Samuels . | |
| 2,884,972 | 5/1959 | Harris | 81/177.1 X |
| 2,951,259 | 9/1960 | Brockner . | |
| 3,046,655 | 7/1962 | Sproson | 30/233 |
| 3,159,913 | 12/1964 | Winton | 30/233 X |
| 4,177,698 | 12/1979 | Greneker | 30/298 X |
| 4,189,831 | 2/1980 | Sonntag | 30/232 |
| 4,599,920 | 7/1986 | Schmid . | |
| 4,829,858 | 5/1989 | Kern et al. . | |
| 5,279,034 | 1/1994 | Smith et al. . | |
| 5,327,652 | 7/1994 | Bulback | 30/233 X |
| 5,659,959 | 8/1997 | Parlowski | 30/232 |

*Primary Examiner*—D. S. Meislin
*Attorney, Agent, or Firm*—Dennison, Meserole, Pollack & Scheiner

[57] ABSTRACT

A protective grip integral with or adapted to mount as an accessory on a handle of a pliers-type tool includes an elongate sleeve extending for a major portion of the handle and along at least the conventional gripping area thereof. The shield has an inner longitudinal edge rigid with the handle and extending therefrom toward the second handle, at least partially closing the space between the handles in laterally outwardly spaced relation to the general plane of the two handles.

3 Claims, 1 Drawing Sheet

PROTECTIVE GRIP FOR PLIERS-TYPE TOOL

BACKGROUND OF THE INVENTION

The invention is broadly concerned with pliers-type tools utilizing pivotally secured crossed arms with opposed jaws at one end thereof manipulated by elongate handles to the opposite side of the pivot from the jaws.

The handles, to obtain maximum leverage, are normally gripped either centrally or toward the outer ends thereof with the space between the handles varying as the handles are opened and closed to accommodate a full range of movement of the jaws. As the handles are normally held in one hand and grasped between the palm pad at the base of the thumb and the fingers, it is not uncommon for portions of the hand, and in particular the fingers, to curve or bulge into the space between the handles as they are moved toward each other. This in turn can provide an annoying, and in some instances disabling, pinching or injury of the hand. This problem is exacerbated in those instances where the jaws slip or accidently disengage from the workpiece, causing the handles to rapidly close in a substantially uncontrolled manner.

SUMMARY OF THE INVENTION

The principal object of the present invention is to provide a means for eliminating the tendency for an accidental placing of a portion of the hand between the handles as they are forceably drawn together, thereby avoiding injury to the hand as the tool is manipulated.

In achieving this, a protective grip is provided on and along one of the handles, preferably the lower handle about which four fingers of the hand normally engage. This grip can be provided as an after-market product which slidably engages on the handle, or as a part of the original device, formed integral with or attached to the handle.

The grip will include an elongate shield or panel-like guard extending along the handle for a major portion thereof from and inward from the free outer end of the handle and for at least the full gripping area of the handle. This shield, lying adjacent one side edge of the handle and either integral therewith or mounted thereto by an elongate sleeve telescopically receiving the handle, extends in a slight laterally outward arc toward the other handle. The shield will normally be of width or height as to extend to or slightly beyond the second handle as the handles are brought to their maximum closed position.

The shield defines a positive rest and protective surface against which the fingers engage, thereby precluding any unintentional engagement of the fingers between the handles. It is also to be recognized that the protective grip does not restrict the positioning of the grasping hand. In other words, the hand, as with conventional pliers and the like, can move to any point along the normal gripping area of the handles without restriction for use in the manner preferred by the individual workman.

Other features and advantages of the invention will become apparent from the more detailed description of the invention following hereinafter.

DESCRIPTION OF PREFERRED EMBODIMENTS

Figure 1:
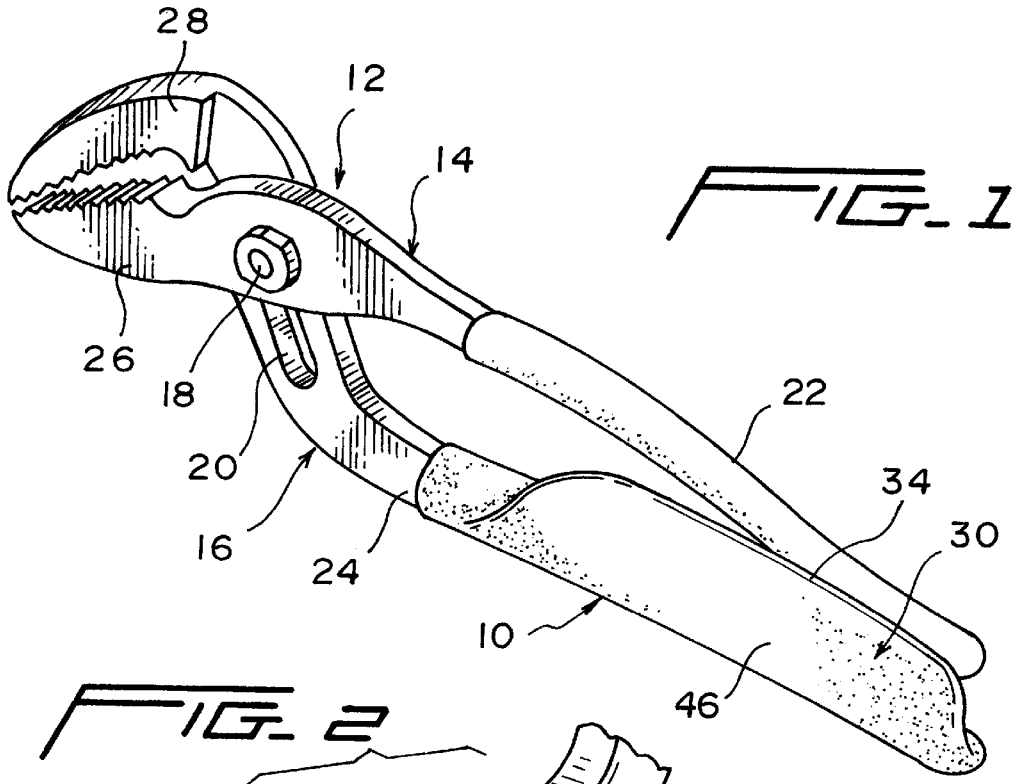
FIG. 1 is a perspective view of a pliers-type tool with the protective grip of the invention mounted thereon.

The protective grip 10 of the invention is particularly intended for use in combination with pincers or pliers-like tools, either as an after market accessory slidably mountable thereon or as an original equipment manufacture, that is integrally formed with the tool at the time of manufacture.

While slip joint pliers have been presented in the drawings for purposes of illustrating invention, it is to be appreciated that the grip of the invention is equally adapted to other forms of pliers and in fact a variety of other types of hand tools incorporating elongate handles which generally parallel each other and are pivotally joined to control a pair of jaws, scissor blades, shears, and the like.

The illustrated pliers 12 includes a pair of elongate crossed arms 14 and 16 which, for purposes of description, will be referred to as an upper arm 14 and a lower arm 16. The arms, at the point of crossing are pivotally secured by an appropriate pivot pin, bolt, or the like 18, the lower arm 16 having an elongate pin accommodating slot 20 therein for adjustment in a known manner.

The crossed arms 14 and 16, to one side of the pivot pin 18, form elongate, overlying, upper and lower handles 22 and 24 having first or inner end portions joined by the pivot 18 and terminating in free outer ends remote from the pivot 18. The arms 14 and 16, to the other side of the pivot 18, form a work engaging head, normally opposed lower and upper jaws 26 and 28 respectively integral with the upper and lower handles 22 and 24. All of this construction is conventional.

The protective grip 10, noting FIG. 1 in particular, is elongate and intended to extend along a major portion of the handle to which it is attached, handle 24 in the illustrated example. The grip, preferably extending completely to the free end of the handle, is intended, while performing a protective function, to allow for a positive grasping of the handles, as desired, along the entire effective length of the gripping portion of the handles for an accommodation of both the particular work site and the individual manipulating of the tool.

Figure 3:
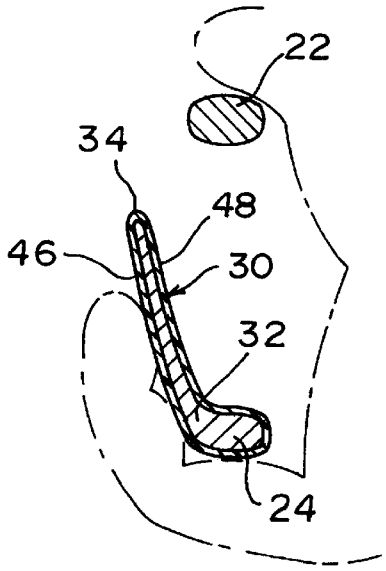
FIG. 3 is a cross-sectional detail through the two handles in an open position with the grip integral with the lower handle and receiving the fingers in a protective manner against the outer surface thereof.
Figure 4:
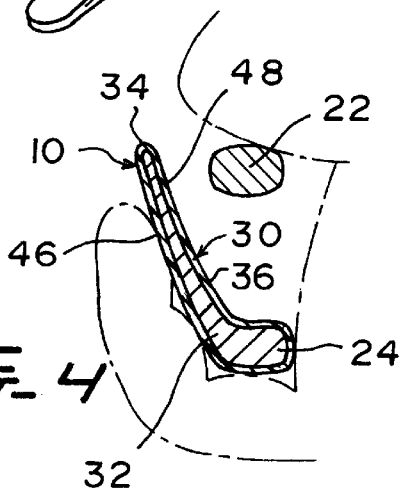
FIG. 4 is a view similar to FIG. 3 with the handles moved to their closed position.

The actual protecting function is performed by an elongate shield or guard 30 extending, when mounted, along the grasping extent of the handle, for example lower handle 24. The lower or inner edge portion 32 of the shield 30 is rigidly affixed to the handle lengthwise therealong with the shield arcing slightly laterally outward of what might be considered the plane of the overlying handles 22 and 24 and toward the second handle, 22 as illustrated, across the space defined between the handles. FIGS. 1 and 4 illustrate the handles in a closed or substantially closed position with the shield's free longitudinal upper edge 34 extending beyond the second handle 22 in laterally outwardly spaced relation thereto. The fingers of the gripping hand, engaging the outer surface of the shield, are held laterally away from the space between the handles. FIG. 3 illustrates, in cross-sectional detail, the plier handles in an open position with the free upper edge 34 of the shield initially only partially closing the gap or space while at the same time fully protecting the hand.

FIGS. 3 and 4 are also of particular interest in illustrating the formation of the shield 30, and hence the protective grip

10, as an integral part of the associated handle 24, thus comprising an integral portion of the tool as manufactured. In such case, the shield itself will be of the same material as the handle and of a strength and rigidity to preclude any flexure as might interfere with its protective function. As illustrated, the shield 30 and corresponding portion of the handle 24 maybe be provided with a grip-enhancing coating 36 molded or otherwise provided thereon. Noting FIG. 1, a similar coating can also be provided on the handle 22.

Figure 2:
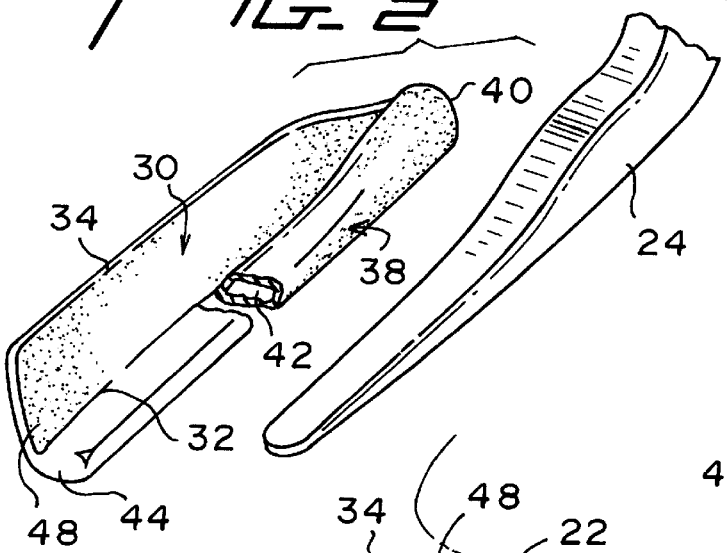
FIG. 2 is an exploded perspective view of the protective grip and handle wherein the grip is formed as a mountable accessory.

With particular reference to FIG. 2, the protective grip 10 therein is presented as an accessory which, in addition to the shield 30, includes an integral, elongate, mounting base 38 which is coextensive with or slightly longer than the shield 30. The mounting base is in the nature of a hollow elongate sleeve having an open forward or leading end 40 through which the corresponding handle 24 is introduced into the hollow interior 42. The mounting base 38, at the end remote from the open leading end 40 has a closed end 44 with the hollow interior 42 preferably extending the full length of the sleeve-like mounting base 38 to the closed following end 44.

The hollow interior 42 is specifically configured to accommodate and intimately receive the tool handle 24. As the tool handle will normally have a configuration other than cylindrical, that is normally wider than thicker, rotation between the mounted sleeve-like base member 38, and hence the entire protective grip 10, relative to the handle will be precluded. When provided as an accessory for previously purchased tools, the protective grip 10 can be removable for alternative use on tools having similarly configured handles. Further, the accessory grip 10, either through extremely tight frictional engagement or through the use of an appropriate adhesive, can be permanently affixed to the tool handle. When provided as an accessory, the protective grip 10 can be formed of any appropriate rigid material, for example metal, an appropriate molded synthetic resin, and the like. In addition, an appropriate gripping and cushioning surface similar to the surface treatment 36, can be applied to the accessory grip of FIG. 2.

The exterior surface 46 of the shield 30, both as an integral portion of the tool and as a mounted accessory, is smooth and continuous along the length thereof, thereby providing an uninterrupted surface along which the hand is free to move to assume the preferred gripping position. The accommodation of the hand, at any point along the protective grip 10, is also enhanced by the slight transverse arcing of the shield or at least the outer surface 46 thereof. The progressively increasing lateral space defined between the shield and the second handle ensures a completely free movement and operation of the two handles without interference from the protective grip in particular the shield portion thereof. It will also be noted that no part of the protective grip is interposed between the handles as might interfere with the operation of the handles, the inner surface 48 of the shield 30 also preferably being smooth and continuous.

The foregoing description and the enclosed embodiments are illustrative of the invention. As variations may occur to those skilled in the art, it is to be appreciated that the invention is only limited by the claims following hereinafter.

I claim:

1. In a hand tool, first and second longitudinally elongate overlying handles, said handles having first forward end portions, pivot means joining said first end portions for pivotal movement of said handles toward and away from each other between a closed position and an open position, a space defined between said handles in said open position, and a work engaging head joined to said handles at said first forward end portions and extending forwardly therefrom beyond said pivot means, said work engaging head being manipulatable in response to movement of said handles between said opened and closed positions; the improvement comprising a protective grip attached to said first handle, said grip including an elongate shield extending along a major portion of said first handle and having an elongate inner edge portion joined to said first handle, said shield having inner and outer surfaces respectively facing toward and away from said space, said outer surface being smooth and uninterrupted along the length thereof and further including an elongate outer edge, said shield, between said inner edge portion and said outer edge, extending from said first handle generally toward and beyond said second handle in laterally outwardly spaced relation to said space defined between said handles when said handles are in said closed position and wherein said shield inner edge portion is integrally formed with said first handle to minimize access to said space by a hand of a user of the tool, and wherein said grip further includes an elongate mounting base for attaching said grip to said first handle, said base being integral with and extending longitudinally along said inner edge portion of said shield, said mounting base engaging said first handle along a substantial portion of said first handle, and wherein said base defines an elongate sleeve with a hollow interior telescopically receiving said first handle.

2. The hand tool of claim 1 wherein said grip is a separable accessory selectively mountable to and removable from said first handle.

3. The protective grip of claim 1 wherein said shield, for the height thereof between said inner edge portion and said outer edge, is laterally arced wherein said lateral outer surface is slightly convex.

* * * * *